US008590735B2

(12) United States Patent
Ward

(10) Patent No.: US 8,590,735 B2
(45) Date of Patent: Nov. 26, 2013

(54) FLIP TOP CONTAINER

(71) Applicant: N. Robert Ward, Bothell, WA (US)

(72) Inventor: N. Robert Ward, Bothell, WA (US)

( * ) Notice: Subject to any disclaimer, the term of this patent is extended or adjusted under 35 U.S.C. 154(b) by 0 days.

(21) Appl. No.: 13/690,850

(22) Filed: Nov. 30, 2012

(65) Prior Publication Data

US 2013/0153574 A1 Jun. 20, 2013

Related U.S. Application Data

(63) Continuation of application No. 13/033,478, filed on Feb. 23, 2011, now abandoned.

(51) Int. Cl.
*B65D 51/04* (2006.01)

(52) U.S. Cl.
USPC ..... 220/839; 220/260

(58) Field of Classification Search
USPC ..... 220/839, 837, 824, 282, 4.23; 215/304, 215/305, 46, 239, 236, 235, 237
See application file for complete search history.

(56) References Cited

U.S. PATENT DOCUMENTS

| | | | |
|---|---|---|---|
| 1,978,272 | A | 10/1934 | Lawrence |
| 4,420,089 | A | 12/1983 | Walker |
| 4,783,056 | A | 11/1988 | Abrams |
| 4,812,116 | A | 3/1989 | Abrams |
| 6,303,064 | B1 | 10/2001 | Abrams |
| 7,059,492 | B2 | 6/2006 | Giraud |
| 7,611,027 | B2 | 11/2009 | Kim |
| 2007/0208274 | A1 | 9/2007 | Ostrowski |

*Primary Examiner* — Anthony Stashick
*Assistant Examiner* — Kevin Castillo
(74) *Attorney, Agent, or Firm* — Christensen O'Connor Johnson Kindness PLLC

(57) ABSTRACT

A container body has a closed bottom and a peripheral wall defining a hollow interior for receipt of desired contents. A cap for the container has a depression constructed and arranged to fit tightly over a top rim of the container body to seal the contents within the hollow interior. The cap can be pried upward to an open position to allow access to the hollow interior. An opening tab hinged to the cap normally extends downward alongside the container body when the cap is closed, but is swingable upward to a horizontal orientation. The tab and cap have cooperating abutments that limit further upward swinging of the tab relative to the cap such that the tab can be used to pry the cap open.

10 Claims, 7 Drawing Sheets

FLIP TOP CONTAINER

CROSS-REFERENCE TO RELATED APPLICATION

This application is a continuation of application Ser. No. 13/033,478, filed Feb. 23, 2011, the disclosure of which is hereby expressly incorporated by reference herein.

BACKGROUND

The present invention relates to containers having tight fitting lids, particularly lids that hermetically seal the interior of the container, and to such containers having flip top caps which are pried away from the container body for opening, as compared, for example, to screw caps or other types of twist caps.

Known flip top containers of the general type with which the present invention is concerned are shown in U.S. Pat. No. 7,059,492, titled "Moisture-proof Resealable, Non-cylindrical Container For Consumer Packages," and U.S. Patent Publication No. 2007/0208274 A1, titled "Sample Collection System And Method." In addition, processes and apparatus for making containers of this general type are disclosed in U.S. Pat. No. 4,783,056 ("Process For Making An Aseptic Vial And Cap"); U.S. Pat. No. 4,812,116 ("Mold For Making An Aseptic Vial And Cap"); and U.S. Pat. No. 6,303,064 ("Process And Apparatus For Making A Leakproof Plastic Container By Completely Ejecting From A Mold And Transferring To A Cap Closing Station"). Reference may be had to these publications and the documents referred to therein (including references cited) for appropriate, representative manufacturing processes and materials.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention provides a container with a tight fitting, flip top cap. The cap may be joined to the upper portion of the container by an integral hinge joint so as to swing between an open position in which the container body is open at the top for insertion or removal of desired contents, and a closed position in which the cap fits tightly on the container, closing and sealing the otherwise open top. An elongated opening tab can be cantilevered from the side of the cap opposite the integral hinge, and can be joined to the cap by a second integral hinge. The opening tab and cap can have cooperating abutments that limit swinging motion of the opening tab relative to the cap. For example, with the cap in the closed position, the opening tab may be swung down alongside the body of the container. From the downward-swung position the tab may swing approximately 90 degrees upward before the cooperating abutments engage to provide increased leverage to pry the tab and cap farther upward for opening the container. Cooperating locking elements and/or tamper evident components can be provided on the cantilevered tab and body of the container.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A flip top container in accordance with the present invention can be used for storing or shipping any desired contents insertable into the hollow body of the container. Without limiting the generality of the foregoing, such products may include liquids, solids, particulates, and so on. As described in more detail below, the container typically will have a tight fitting cap that can be swung to a position to seal the otherwise open end of the body of the container and reliably stay in the closed position until opening is desired. In accordance with the present invention, the cap is provided with a cantilevered, hinged opening tab which cooperates with the cap during reopening.

Figure 1:
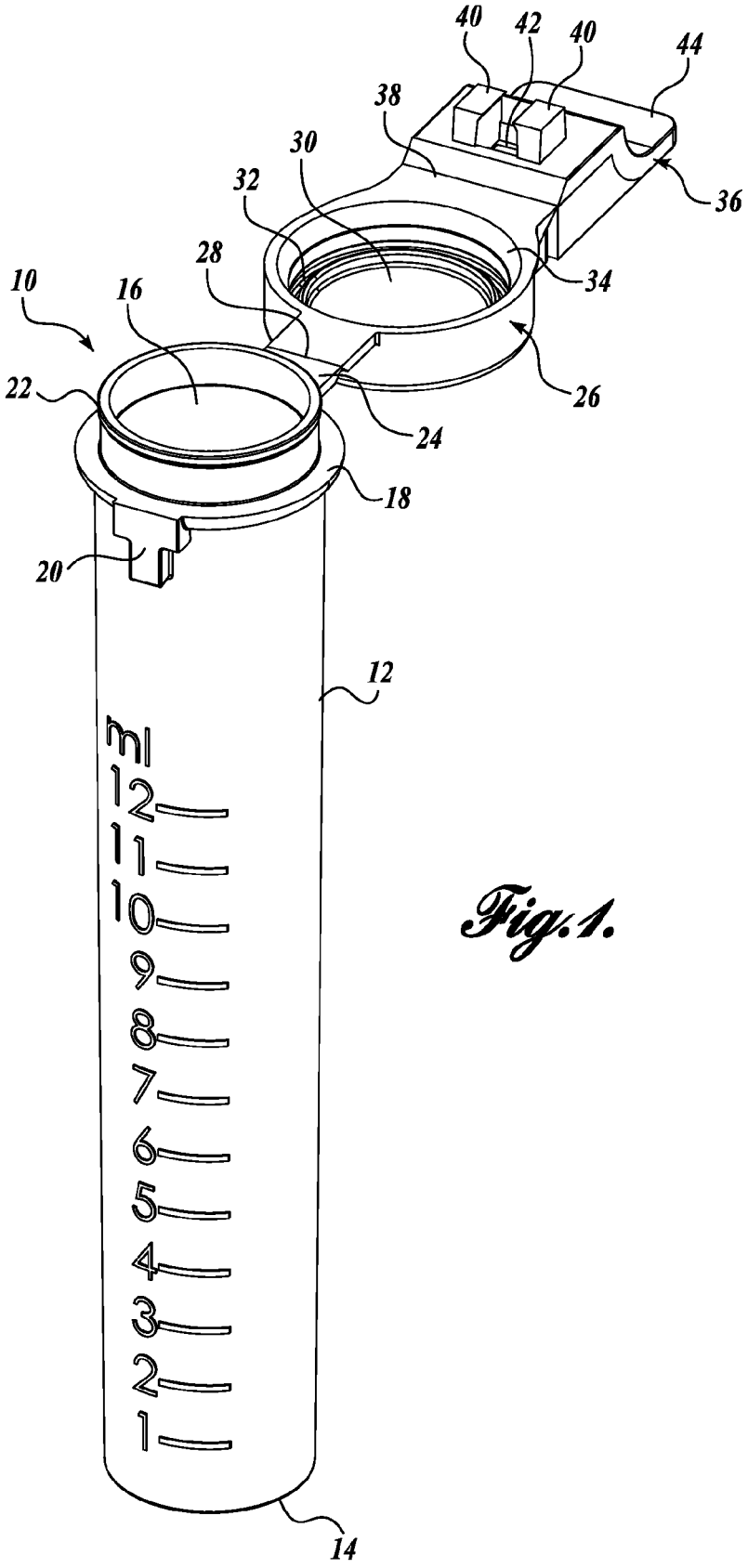
FIG. 1 is a top front perspective of a flip top container in accordance with the present invention, illustrating an open condition of the container.

The container 10 in accordance with the present invention shown in FIG. 1 is formed from a single piece of a suitable plastic, which may be determined by the intended contents and the desired fit of the component parts of the container. In the representative embodiment illustrated, the container has a substantially cylindrical, thin walled body or vial 12 closed at the bottom 14 and having a top opening 16 for access to the hollow interior of the vial. An annular peripheral flange 18 is positioned below the top opening 16 and has a flat top surface. A T-shaped latch block 20 projects down from the flange 18. The top portion of the vial can have a slightly enlarged rim 22.

A short hinge tab 24 projects horizontally outward from the flange 18 directly opposite from the latch block 20. A flip top cap 26 for the vial is pivotally joined to tab 24 by an integral hinge 28. The cap has a continuous peripheral wall defining a central depression 30 sized to receive the portion of the vial between its top and the peripheral flange 18. The interior of the cap depression is formed with a circumferential groove 32 to tightly receive the top rimmed portion 22 of the vial when the cap is swung from the open condition shown in FIG. 1 to the closed condition shown in FIGS. 2 and 3 about the opening-closing axis of the integral hinge 28. In the closed condition, the central portion of the cap extends over the top opening of the vial. The cap 26 can include a bevel 34 at the opening of the depression 30 to assist in guiding the peripheral wall of the cap down over the vial as the cap is swung closed.

A cantilever opening tab 36 is joined to the cap 26 by a second integral hinge 38 that has a tab swinging axis that extends parallel to the opening-closing axis of the first hinge 28, but at the opposite side of the cap depression 30. As shown in the drawings, hinge 38 provides the only connection of the tab 36 to the cap 26, so that the opening tab is free swinging about its hinge without any other structural connection to the tab or vial. The opening tab 36 has a pair of spaced latch fingers 40 which flank an opening or aperture 42 that extends through tab 36. The free end portion 44 of the cantilever tab 36 extends generally oppositely from the integral hinge 38.

Figure 2:
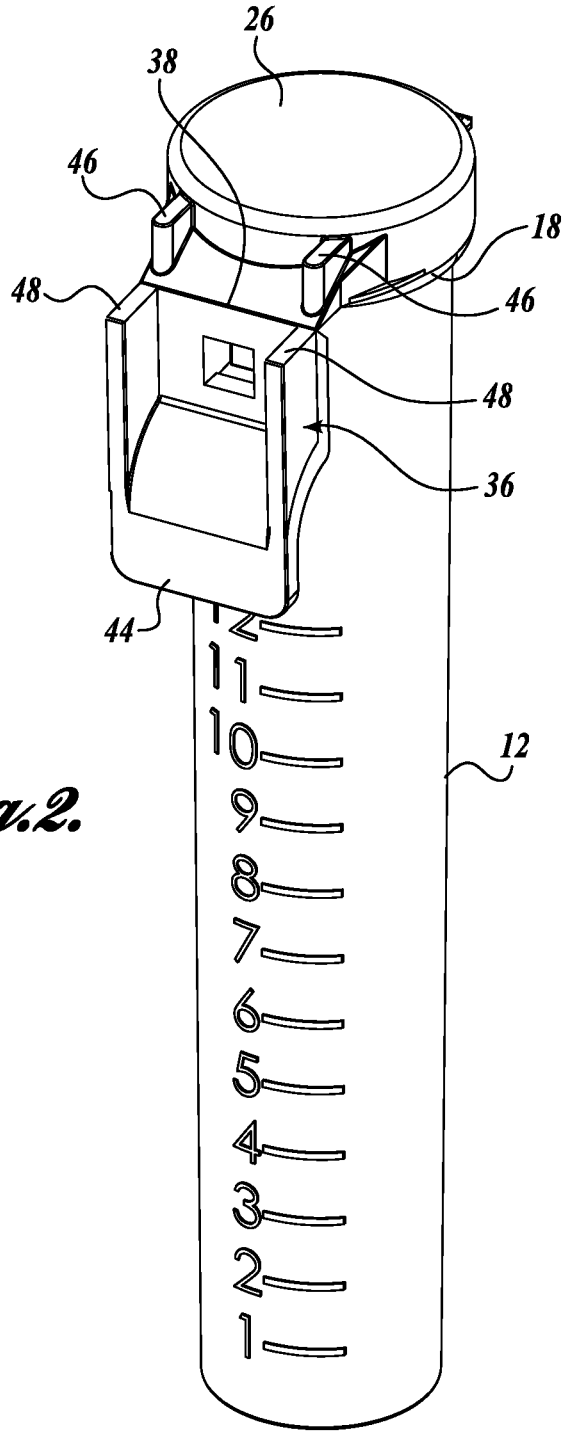
FIG. 2 is a top front perspective corresponding to FIG. 1, but with parts in different positions, illustrating a closed condition of the container.
Figure 3:
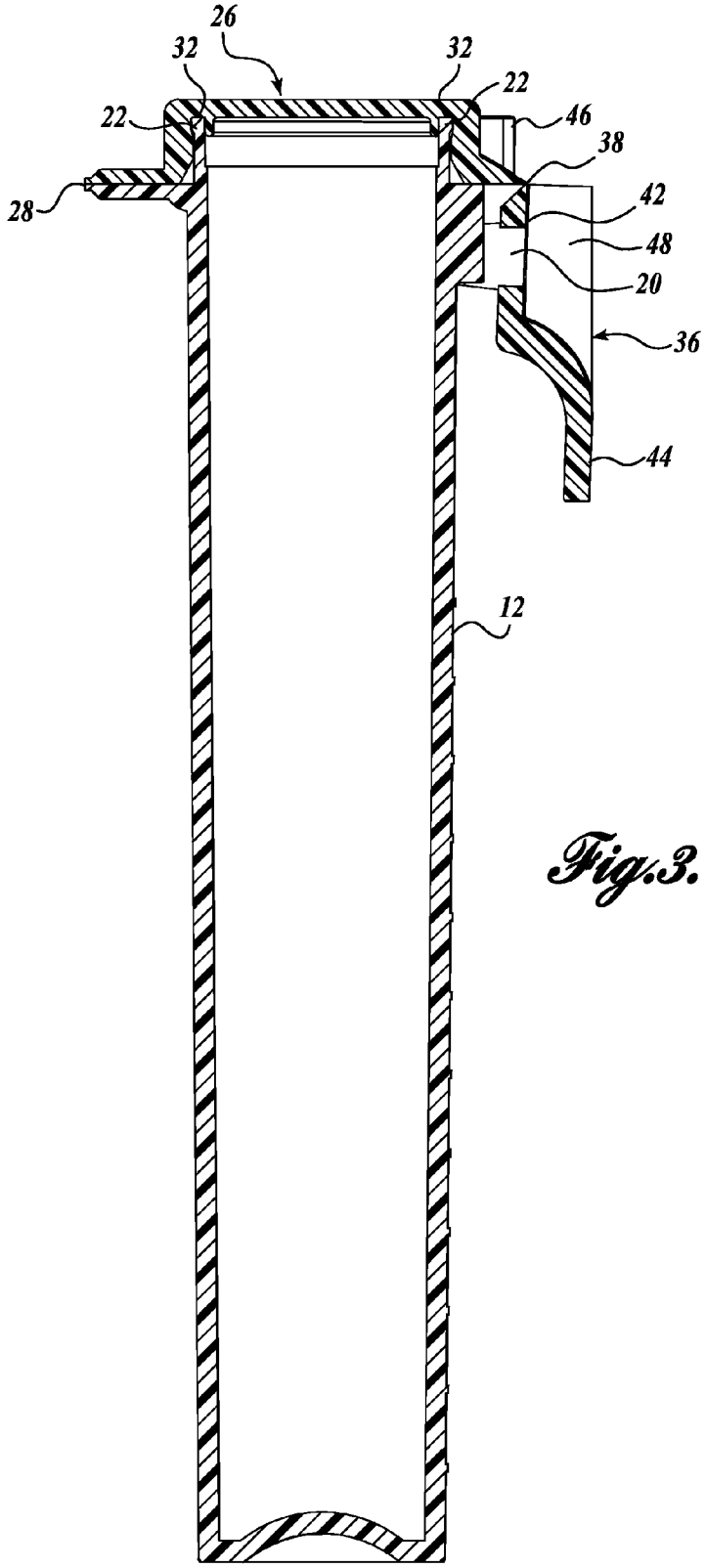
FIG. 3 is a vertical section of the container of FIG. 2.

The cap 26 can be swung about the opening-closing axis of the hinge 28 through an angle of approximately 180 degrees from the open position shown in FIG. 1 to the closed sealing position shown in FIGS. 2 and 3. The flange 18 of the vial 12 limits insertion of the cap downward over the top of the vial. With the cap closed, the tab 36 can be swung an additional 90 degrees to an upright orientation in which it extends down alongside the upright wall of the vial. In such position, the free end portion 44 is spaced outward from the adjacent wall of the vial, a substantial distance below the flange 18. Cooperating abutments are formed on the cap 26 and tab 36, namely, cap abutments 46 and tab abutments 48. The cap abutments 46 can be short stubs that project outward from the peripheral wall of the cap toward (and close to) the integral hinge 38. Abutments 48 can be upright stubs or walls that extend along opposite sides of the tab 36 toward (and close to) the hinge 38. The outer edges of the stubs 46 extend vertically in alignment with the upper edges of the stubs or walls 48.

As best seen in FIG. 3, in the closed position of the cap the top edge portions 22 of the vial fit tightly in the groove 32 of the cap. FIG. 3 also illustrates the overhang or spacing between the free end portion 44 of the tab 36 and the upright wall of the vial 12. In this embodiment, the latch block 20 projecting from the wall of the vial is sized to be grasped snugly between the latch fingers 40 at opposite sides of the opening 42 to assist in retaining the tab until it is desired to manually open the cap again.

As noted at the outset, the container can be used for storing or shipping any desired contents. Nevertheless, container 10 is particularly adapted for use with contents for which a hermetic seal within the container is desired. Examples are samples and/or suspension or buffer solutions, or reagents used in sample collecting systems. Representative collecting systems are those used for drug testing, medical testing, environmental sampling (for food processing, for example), and so on. In such cases, the vial is open (i.e., the cap is swung from the closed sealing position to the open position as described above) and a sample or a swab used to collect a sample may be inserted into and then sealed within the container (by swinging the cap back to the closed sealing position). The vial can then be shipped to a laboratory where the vial is opened for analysis of the sample. Buffer solutions and/or reagents may be preloaded into the vial. To achieve the desired hermetic seal, the cap of the container must fit tightly over the top of the vial, and sometimes the reliability of the closure is enhanced by the latch fingers and tabs. The tighter the latch and the fit of the cap on the vial, the more force will be required to separate the parts during reopening. Not only can this be difficult, but jostling, spilling, or contamination can result.

Figure 4:
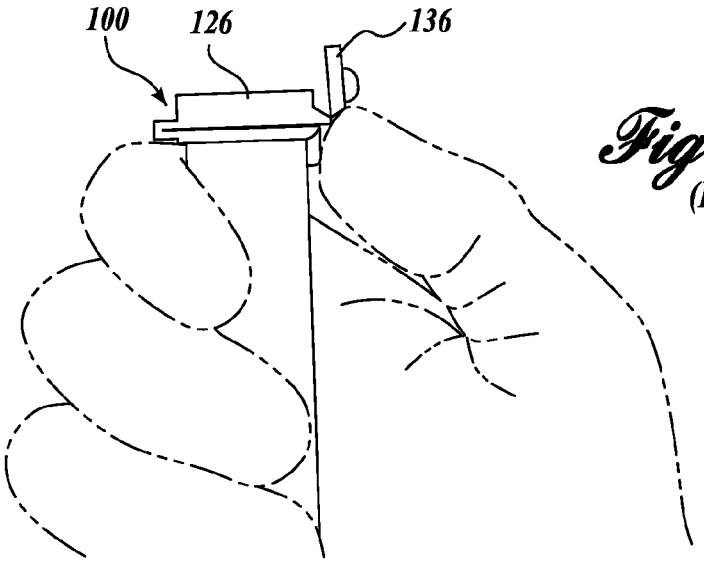
Fig.4. (PRIOR ART)
FIG. 4 is a diagrammatic side elevation of a prior art container in a closed condition, but ready for opening.
Figure 5:
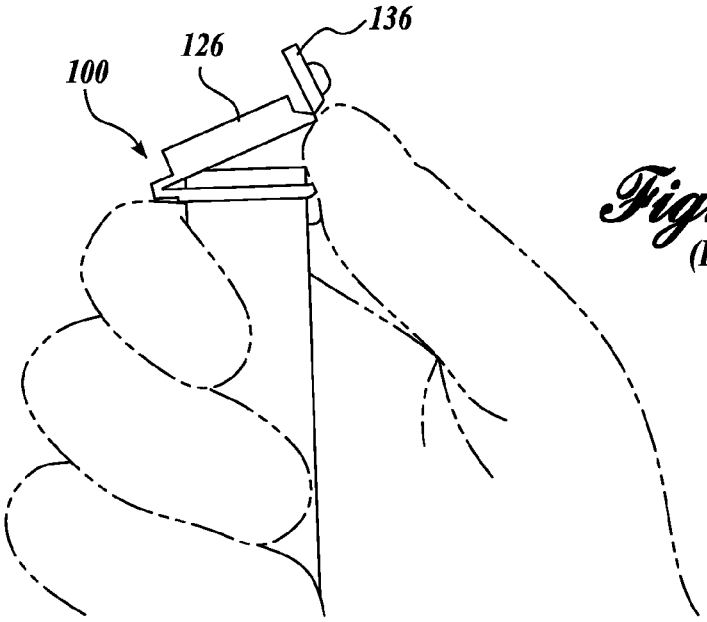
Fig.5. (PRIOR ART)
FIG. 5 is a corresponding side elevation of the container of FIG. 4 with parts in different positions.

For example, FIGS. 4 and 5 diagrammatically illustrate a common procedure for reopening a conventional flip top vial 100. A latch tab 136 may be provided but typically fits close against the wall of the vial when closed. If a tight, reliable latch is used, swinging the tab 136 upward to the position of FIG. 4 can be difficult. Thereafter, the cap 126 is pried upward from one narrow edge as represented in FIG. 5. If the cap fits tightly, substantial force is required, and the cap may pop open resulting in loss of some of the contents. Another possibility is contamination of the container by contact with part of the hand as the thumb is used to pry the cap open.

Figure 6:
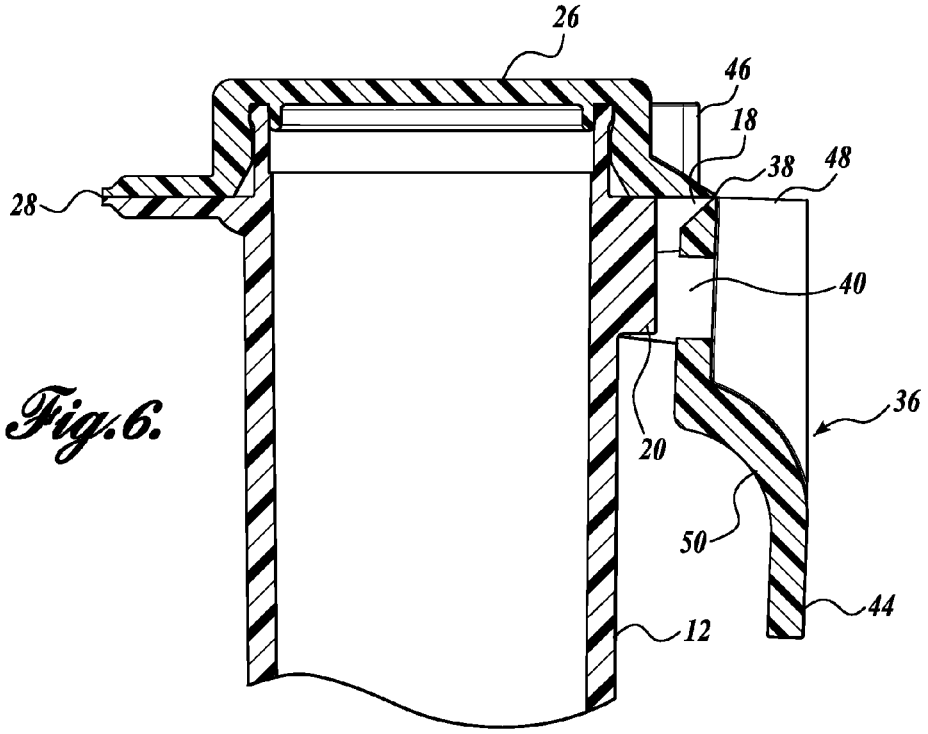
FIG. 6 is an enlarged fragmentary section of the upper portion of the container of FIGS. 1 and 2.
Figure 7:
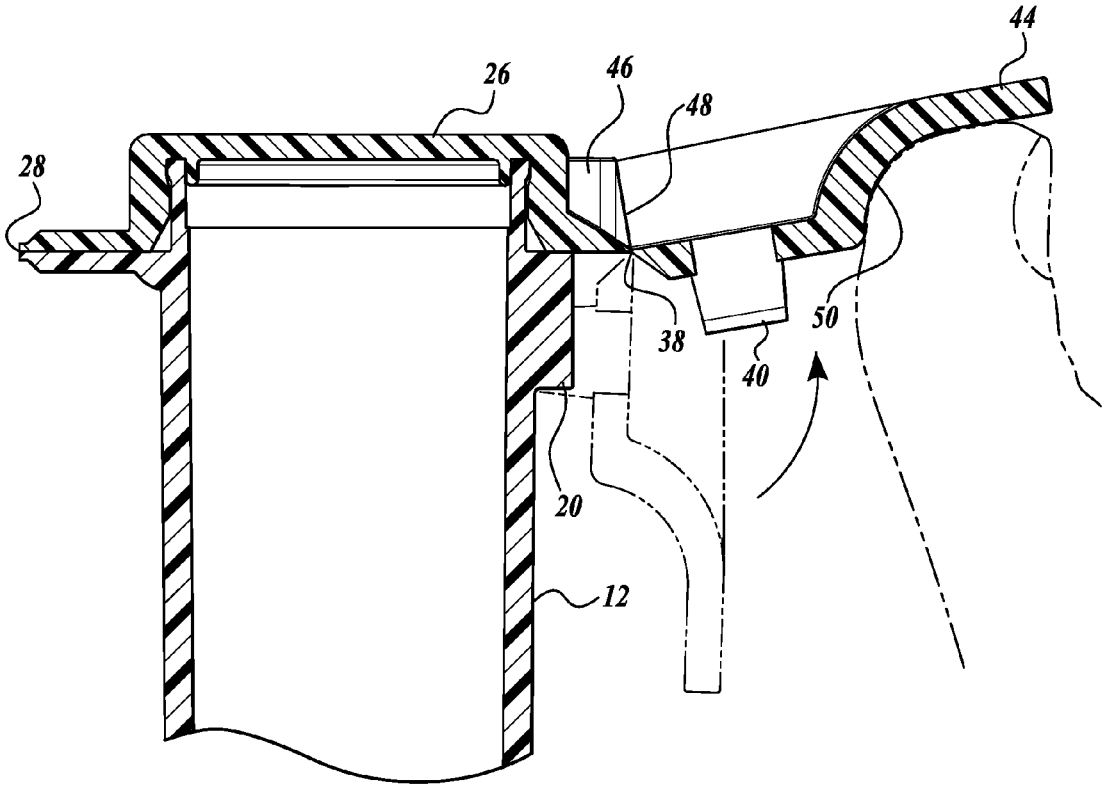
FIG. 7 is a corresponding section with parts in different positions.
Figure 8:
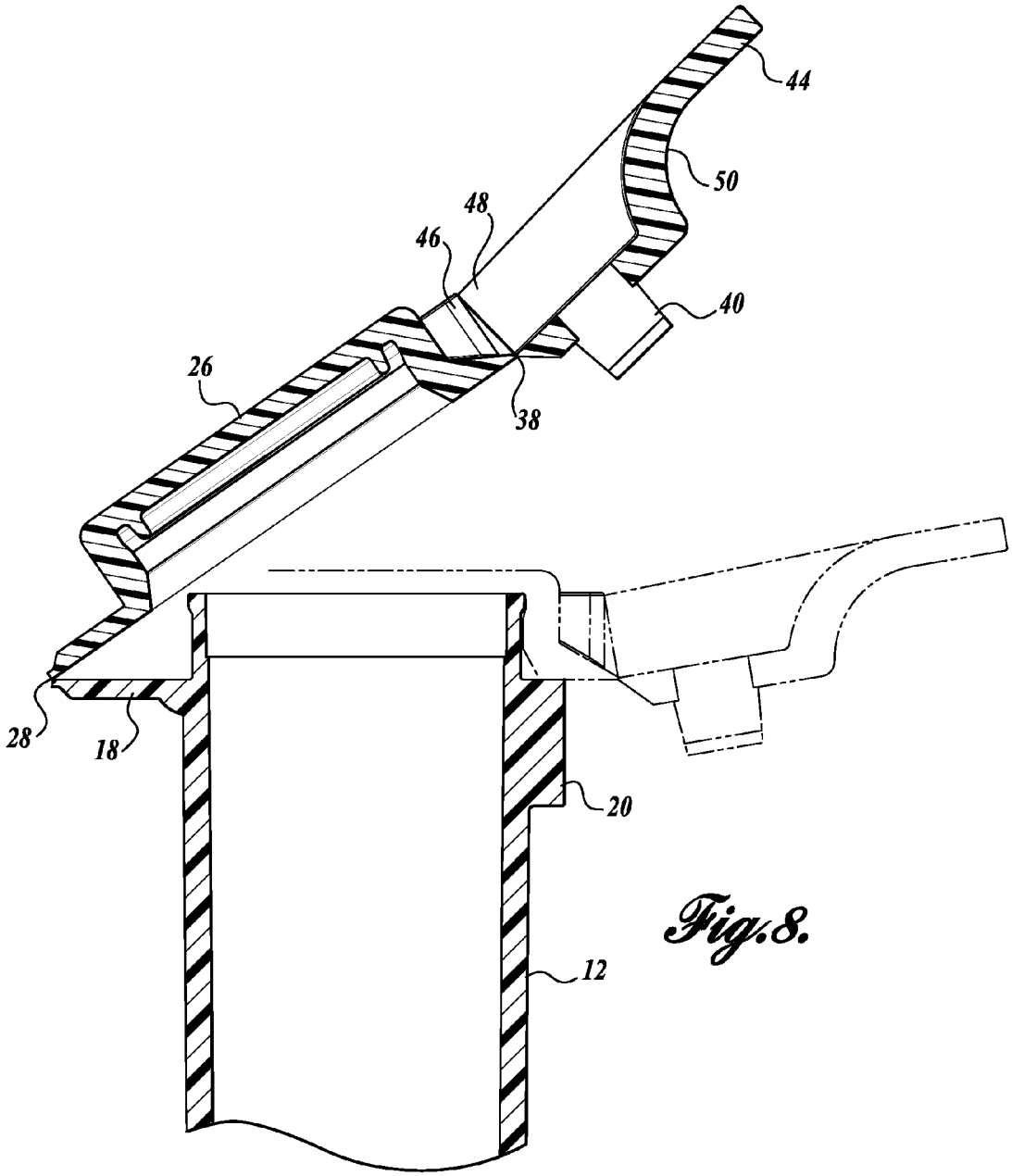
FIG. 8 is another corresponding section with parts in different positions.

In the present invention, however, as best seen in FIGS. 6, 7, and 8, the opening tab 36 is designed to achieve increased leverage during opening and decreased possibility of contamination. In the closed position illustrated in FIG. 6, the free end portion 44 of the opening tab 36 extends down below the latch block 20. Preferably the lower end of the opening tab 36 when closed is spaced below the block 20 a distance at least as great as the distance from the lower edge of the block to the top of the circumferential flange 18 from which it extends. In addition, the free end portion 44 of the opening tab 36 is curved outward to form a finger notch or depression 50 and to provide the increased overhang or space between end portion 44 and the adjacent side of the vial 12.

The opening tab 36 forms a first class 2 lever with the integral hinge joint 38 being the fulcrum. Consequently, increased leverage is provided for a smooth, convenient, and reliable unlatching of the opening tab even if the latch fingers 40 tightly grasp the latch block 20. During opening the user's thumb fits in the depression 50 at a location remote from the vial 12.

When tab 36 is swung to the horizontal orientation of FIG. 7, the abutments 46 and 48 engage, at which point a longer class 2 lever is effectively formed, with the integral hinge joint 28 at the opposite side being the fulcrum. Increased leverage makes for easier, smoother, and more reliable opening by prying of the cap 26 upward without risk of contamination of the rim of the vial or its contents by contact with the finger as the cap is moved to the open position as shown in FIG. 8. The parts can be proportioned for a tighter seal without jeopardizing the integrity of the contents or requiring special tools or a special opening procedure. In this embodiment the cap can be opened and closed as needed without structural damage that could interfere with the tight seal in the closed position of the cap.

Figure 9:
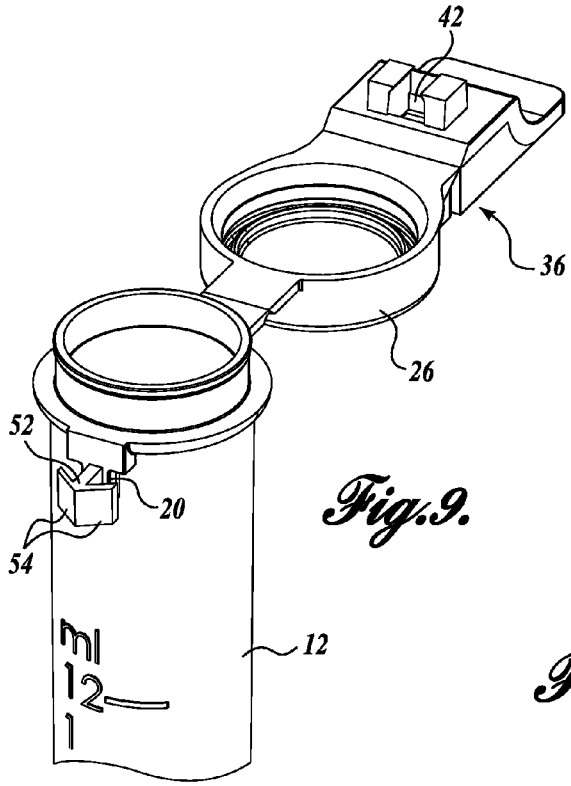
FIG. 9 is a fragmentary top perspective of an alternative embodiment of a flip top container illustrating an open condition of the container.
Figure 10:
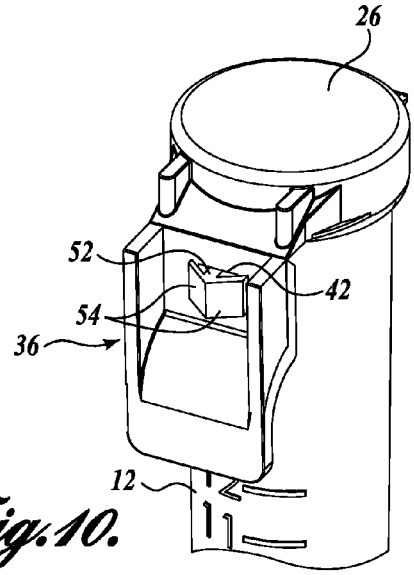
FIG. 10 is a corresponding fragmentary top perspective illustrating a closed condition of the container of FIG. 9.
Figure 11:
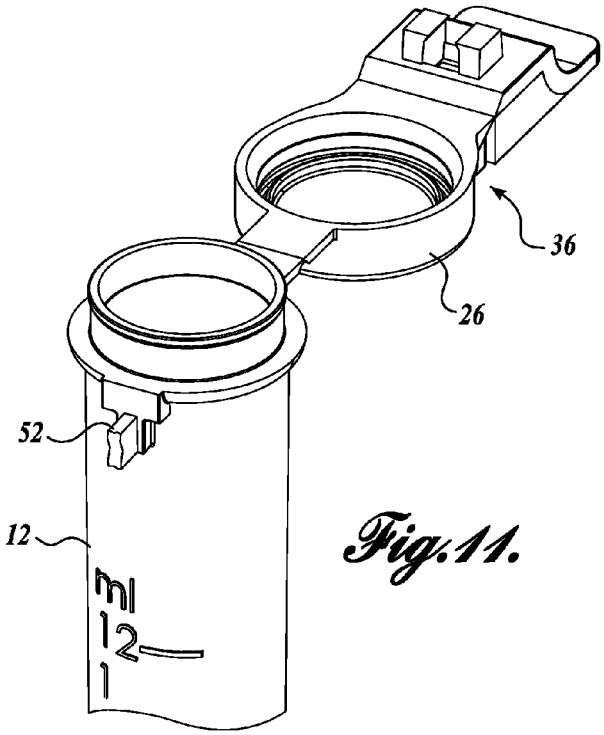
FIG. 11 is another corresponding section illustrating a reopened condition of the container; the parts being shown diagrammatically to illustrate a tamper evident feature.

A container in accordance with the present invention can be modified to have a tamper-evident component, which will immediately indicate whether or not the vial has been opened or reopened. In the embodiment shown in FIGS. 9, 10, and 11, the tamper-evident component has a narrow stem 52 joined to the latch block 20. Wings 54 are angled oppositely from the stem and will squeeze together to fit through the opening 42 of the tab 36 when it is closed to the condition of FIG. 10. The wings then inherently spring to the outward-swung condition in which they overlie the margins of the tab 36 adjacent to the opening 42. The stem is engineered such that it will not withstand the force of reopening when the tab 36 is swung back up. As indicated in FIG. 11, the broken stem remains, providing and immediate and reliable indication that the container has been reopened. It is thus assured that the container will not be reused by mistake, and it is also indicated if the container has been purposefully or inadvertently reopened which could contaminate the contents.

While illustrative embodiments have been illustrated and described, it will be appreciated that various changes can be made therein without departing from the spirit and scope of the invention.

The embodiments of the invention in which an exclusive property or privilege is claimed are defined as follows:

1. A flip top container comprising:

a container body having a closed bottom, a continuous peripheral wall defining a hollow interior, and an open top for access to the hollow interior and having a top rim portion;

a cap pivotally joined to the top portion of the container for swinging relative thereto about an opening-closing axis, the cap having a central portion and a continuous peripheral wall defining a depression of a size to fit tightly over the rim portion of the container body to seal the hollow interior in a closed sealing position of the cap, the cap being manually swingable upward from the closed sealing position to an open position allowing access to the hollow interior and thereafter back downward to the closed sealing position, the cap being swingable between the closed sealing position and the open position without structural damage to the cap and without interfering with the seal of the cap to the container in the closed sealing position after swinging from the closed sealing position to the open position and back to the closed sealing position; and an elongated, cantilever opening tab joined to the peripheral wall of the cap by a tab hinge having a tab swinging axis, the opening tab being manually swingable about the tab swinging axis when the cap is in the closed position from a first orientation extending down from the cap alongside the peripheral wall of the container body to a horizontal orientation extending outward from the tab hinge in a direction away from the cap central portion, the cap and opening tab having cooperating abutments adjacent to the tab swinging axis which abutments are positioned to engage when the opening tab is swung to the horizontal orientation thereby enabling the cap to be pried upward by manipulation of the opening tab as it is moved to and beyond the horizontal position with the cooperating abutments engaged, said abutments including at least one cap stub integral with the peripheral wall of the cap and extending therefrom in a direction away from the peripheral wall toward the tab hinge and a tab stub integral with the opening tab, the tab stub being aligned with the cap stub and being constructed and arranged to engage against the cap stub when the tab is moved to and beyond the horizontal position.

2. The container defined in claim 1, in which the cooperating abutments of the tab and the cap are adjacent to but on opposite sides of the tab swinging axis, respectively.

3. The container defined in claim 1:

in which the abutments include two cap stubs integral with and spaced apart circumferentially of the peripheral wall of the cap and two tab stubs integral with the opening tab and positioned to engage against the two tab stubs, respectively, when the opening tab is moved to and beyond the horizontal position.

4. The container defined in claim 3, in which the tab stubs and the cap stubs are adjacent to but on opposite sides of the tab swinging axis respectively.

5. The container defined in claim 1, in which the cap is joined to the container body by an integral cap hinge located at the opposite side of the container body from the tab hinge and defining the opening-closing axis.

6. The container defined in claim 5, in which the container body, cap, and opening tab are plastic and integral with each other.

7. The container defined in claim 6, in which the opening tab is swingable 90 degrees from the first orientation to the horizontal orientation before the cooperating abutments engage.

8. The container defined in claim 1, in which the opening tab and the container body have cooperating components that interfit to latch the opening tab to the side of the container body in the first orientation.

9. The container defined in claim 1, in which the opening tab has a curved finger notch at its end portion remote from the tab hinge such that the opening tab has a free end portion spaced outward from and overlying the peripheral wall of the container body when the tab is in the first orientation.

10. The container defined in claim 1, in which the opening tab has a free end portion spaced outward from and overlying the peripheral wall of the container body when the tab is in the first orientation for ease in manually prying the opening tab upward from the first orientation toward the horizontal orientation.

* * * * *